US006461133B1

(12) United States Patent
Lake et al.

(10) Patent No.: US 6,461,133 B1
(45) **Date of Patent: *Oct. 8, 2002**

(54) BREAKER PLATE ASSEMBLY FOR PRODUCING BICOMPONENT FIBERS IN A MELTBLOWN APPARATUS

(75) Inventors: Matthew Lake, Cumming, GA (US); Darryl Clark, Alpharetta, GA (US); Bryan D. Haynes, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/573,865

(22) Filed: May 18, 2000

(51) Int. Cl.[7] ..... D01D 5/30

(52) U.S. Cl. ..... 425/7; 425/72.2; 425/131.5; 425/192 S; 425/198; 425/199; 425/463

(58) Field of Search ..... 425/131.1, 192 S, 425/198, 199, 463, 7, 72.2, 131.5; 264/172.13, 172.14, 172.15

(56) References Cited

U.S. PATENT DOCUMENTS

| | | | | |
|---|---|---|---|---|
| 3,200,440 A | | 8/1965 | Bryan et al. | |
| 3,237,245 A | | 3/1966 | Nonami et al. | |
| 3,245,113 A | | 4/1966 | Sulich | |
| 3,425,091 A | | 2/1969 | Ueda et al. | |
| 3,584,339 A | | 6/1971 | Kamachi et al. | |
| 3,601,846 A | | 8/1971 | Hudnall | |
| 3,730,662 A | | 5/1973 | Nunning | |
| 3,787,162 A | | 1/1974 | Cheetham | |
| 3,981,650 A | | 9/1976 | Page | |
| 4,052,146 A | | 10/1977 | Sternberg | |
| 4,167,384 A | * | 9/1979 | Shirato et al. | 425/199 |
| 4,251,200 A | | 2/1981 | Parkin | |
| 4,293,516 A | | 10/1981 | Parkin | |
| 4,308,004 A | | 12/1981 | Chion et al. | |
| 4,358,375 A | * | 11/1982 | Wood | 425/199 |
| 4,406,850 A | | 9/1983 | Hills | |
| 4,411,852 A | | 10/1983 | Bromley et al. | |

(List continued on next page.)

FOREIGN PATENT DOCUMENTS

| | | | |
|---|---|---|---|
| EP | 0474421 | * | 3/1992 |
| EP | 0646663 | | 4/1995 |
| EP | 0553419 | | 6/1997 |
| EP | 0561612 | | 7/1997 |
| EP | 0786543 | | 7/1997 |
| JP | 02182911 | * | 7/1990 |
| WO | WO 9932692 | | 7/1999 |

OTHER PUBLICATIONS

PCT Application PCT/US01/14675 May 15, 2002.

* cited by examiner

*Primary Examiner*—Jan H. Silbaugh
*Assistant Examiner*—Joseph Layson
(74) *Attorney, Agent, or Firm*—Dority & Manning, P.A.

(57) ABSTRACT

A die head assembly for producing bicomponent meltblown fibers includes a die tip detachably mountable to a support member. The support member conveys first and second polymers separately to the die tip. The die tip has a row of channels defined therethrough that terminate at exit orifices or nozzles along the bottom edge of the die tip. These channels receive and combine the separate first and second polymers conveyed from the support member. An elongated recess is defined in the top surface of the die tip. The recess defines an upper chamber for each of the die tip channels. Stacked breaker plates are removably supported in the recess. The breaker plates have vertically aligned pairs of adjacent holes defined therethrough such that a pair of the aligned holes is disposed in each upper chamber of each channel. A filter screen is in the recess to separately filter the polymers.

11 Claims, 3 Drawing Sheets

U.S. PATENT DOCUMENTS 4,445,833 A 5/1984 Moriki et al.
4,526,733 A 7/1985 Lau
4,648,826 A 3/1987 Ogasawara et al.
4,717,325 A 1/1988 Fujimura et al.
4,738,607 A 4/1988 Nakajima et al.
4,846,653 A 7/1989 Beck et al.
5,035,595 A 7/1991 Nakajima et al.
5,080,569 A * 1/1992 Gubernick et al. ..... 425/72.2
5,145,689 A 9/1992 Allen et al.
5,162,074 A 11/1992 Hills
5,196,207 A * 3/1993 Koenig ..... 425/72.2
5,196,211 A 3/1993 Goossens
5,227,109 A 7/1993 Allen, III et al.
5,234,650 A 8/1993 Hagen et al.
5,344,297 A 9/1994 Hills
5,366,804 A 11/1994 Dugan
5,466,410 A 11/1995 Hills
5,511,960 A 4/1996 Terakawa et al.
5,562,930 A 10/1996 Hills
5,601,851 A 2/1997 Terakawa
5,618,328 A 4/1997 Lin et al.
5,632,938 A 5/1997 Buehning, Sr.
5,632,944 A 5/1997 Blackwell
5,733,586 A 3/1998 Herwegh et al.
5,851,562 A 12/1998 Haggard et al.
5,935,883 A 8/1999 Pike
5,989,004 A 11/1999 Cook
6,120,276 A * 9/2000 Balk ..... 425/131.5
6,336,801 B1 * 1/2001 Fish et al. ..... 425/72.2

BREAKER PLATE ASSEMBLY FOR PRODUCING BICOMPONENT FIBERS IN A MELTBLOWN APPARATUS

BACKGROUND

The present invention relates to a die head assembly for a meltblown apparatus, and more particularly to a process and breaker plate assembly for producing bicomponent fibers in a meltblown apparatus.

A meltblown process is used primarily to form fine thermoplastic fibers by spinning a molten polymer and contacting it in its molten state with a fluid, usually air, directed so as to form and attenuate filaments or fibers. After cooling, the fibers are collected and bonded to form an integrated web. Such webs have particular utility as filter materials, absorbent materials, moisture barriers, insulators, etc.

Conventional meltblown processes are well known in the art. Such processes use an extruder to force a hot thermoplastic melt through a row of fine orifices in a die tip head and into high velocity dual streams of attenuating gas, usually air, arranged on each side of the extrusion orifice. A conventional die head is disclosed in U.S. Pat. No. 3,825,380. The attenuating air is usually heated, as described in various U.S. Patents, including U.S. Pat. Nos. 3,676,242; 3,755,527; 3,825,379; and 3,825,380. Cool air attenuating processes are also know form U.S. Pat. No. 4,526,733; WO 99/32692 and U.S. Pat. No. 6,001,303.

As the hot melt exits the orifices, it encounters the attenuating gas and is drawn into discrete fibers which are then deposited on a moving collector surface, usually a foraminous belt, to form a web of thermoplastic material. For efficient high speed production, it is important that the polymer viscosity be maintained low enough to flow and prevent clogging of the die tip. In accordance with conventional practice, the die head is provided with heaters adjacent the die tip to maintain the temperature of the polymer as it is introduced into the orifices of the die tip through feed channels. It is also known, for example from EP 0 553 419 B1, to use heated attenuating air to maintain the temperature of the hot melt during the extrusion process of the polymer through the die tip orifices.

Bicomponent meltblown spinning processes involve introducing two different polymers from respective extruders into holes or chambers for combining the polymers prior to forcing the polymers through the die tip orifices. The resulting fiber structure retains the polymers in distinct segments across the cross-section of the fiber that run longitudinally through the fiber. The polymers are generally "incompatible" in that they do not form a miscible blend when combined. Examples of particularly desirable pairs of incompatible polymers useful for producing bicomponent or "conjugate" fibers is provided in U.S. Pat. No. 5,935,883. These bicomponent fibers may be subsequently "split" along the polymer segment lines to form microfine fibers. A process for producing microfine split fiber webs in a meltblown apparatus is described in U.S. Pat. No. 5,935,883.

A particular concern with producing bicomponent fibers is the difficulty in separately maintaining the polymer viscosities. It has generally been regarded that the viscosities of the polymers passing through the die head should be about the same, and are achieved by controlling the temperature and retention time in the die head and extruder, the composition of the polymers, etc. It has generally been felt that only when the polymers flow through the die head and reach the orifices in a state such that their respective viscosities are about equal, can they form a conjugate mass that can be extruded through the orifices without any significant turbulence or break at the conjugate portions. When a viscosity difference occurs between the respective polymers due to a difference in molecular weights and even a difference in extrusion temperatures, mixing in the flow of the polymers inside the die head occurs making it difficult to form a uniform conjugate mass inside the die tip prior to extruding the polymers from the orifices. U.S. Pat. No. 5,511,960 describes a meltblown spinning device for producing conjugate fibers even with a viscosity difference between the polymers. The device utilizes a combination of a feeding plate, distributing plate, and a separating plate within the die tip.

There remains in the art a need to achieve further economies in meltblown processes and apparatuses for producing bicomponent fibers from polymers having distinctly different viscosities.

SUMMARY OF THE INVENTION

Objects and advantages of the invention will be set forth in the following description, or may be apparent from the description, or may be learned through practice of the invention.

The present invention relates to an improved die head assembly for producing bicomponent fibers in a meltblown spinning apparatus. It should be appreciated that the present die head assembly is not limited to application in any particular type of meltblown device, or to use of any particular combination of polymers. It should also be appreciated that the term "meltblown" as used herein includes a process that is also referred to in the art as "meltspray."

The die head assembly according to the invention includes a die tip that is detachably mounted to an elongated support member. The support member may be part of the die body itself, or may be a separate plate or component that is attached to the die body. Regardless of its configuration, the support member has, at least, a first polymer supply passage and a separate second polymer supply passage defined therethrough. These passages may include, for example, grooves defined along a bottom surface of the support member. The grooves may be supplied by separate polymer feed channels.

The die tip has a row of channels defined therethrough that terminate at exit orifices or nozzles along the bottom edge of the die tip. These channels receive and combine the first and second polymers conveyed from the support member.

An elongated recess is defined in the top surface of the die tip. This recess defines an upper chamber for each of the die tip channels. An elongated upstream breaker plate and an elongated downstream breaker plate are removably supported in a stacked configuration within the recess. Each of the breaker plates has pairs of adjacent holes defined therethrough. The holes in the stacked breaker plates are aligned such that a pair of the aligned holes is disposed in each upper chamber of the die tip channels. In one embodiment, the upstream breaker plate has a top surface that lies flush with, or in the same plane as, the upper surface of the die tip. In this embodiment, the top surface of the die tip is mountable directly against the underside of the support member. The holes in the upstream breaker plate are spaced apart and sized so that they align with the separate supply passages or grooves defined in the underside of the supply member. In this manner, the polymers are prevented from crossing over or mixing between the holes, and are maintained completely separate as they are conveyed into the breaker plates.

A filter device, such as a mesh screen, is disposed in the recess, for example between the upstream and downstream breaker plates. The filter device serves to separately filter the polymers conveyed through the breaker plate holes prior to the polymers entering and combining in the die tip channels.

At each of the channels, the first and second polymers are conveyed from the support member supply grooves or passages and flow through respective separate holes in the upstream breaker plate. The polymers flow through and are separately filtered by the filter device. The polymers finally flow through the aligned holes in the downstream breaker plate and into the die tip channels. In the channels, the polymers merge into a single molten mass having an interface or segment line between the separate polymers prior to being extruded as bicomponent polymer fibers from the die tip orifices.

The breaker plate holes may take on various configurations and sizes. In one embodiment, each hole of the pair of holes in the upstream breaker plate have the same diameter. The holes in the downstream breaker plate may also have the same diameter, and this diameter may be the same as that of the holes of the upstream breaker plate. In an alternative embodiment, the individual holes of the pair of holes in the upstream breaker plate may have different diameters. The downstream breaker plate holes may have correspondingly sized different diameters. It should be readily apparent that various combinations of hole sizes or patterns may be configured in the breaker plates.

The invention will be described in greater detail below with reference to the appended figures.

DETAILED DESCRIPTION

Reference will now be made in detail to embodiments of the invention, one or more examples of which are set forth in the figures and described below. Each example is provided by way of explanation of the invention, and not meant as a limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield still a further embodiment. Thus, it is intended that the present invention include such modifications and variations.

The present invention relates to an improved die assembly for use in any commercial or conventional meltblown apparatus for producing bicomponent fibers. Such meltblown apparatuses are well known to those skilled in the art and a detailed description thereof is not necessary for purposes of an understanding of the present invention. A meltblown apparatus will be described generally herein to the extent necessary to gain an appreciation of the invention.

Processes and devices for forming bicomponent or "conjugate" polymer fibers are also well known by those skilled in the art. Polymers and combinations of polymers particularly suited for conjugate bicomponent fibers are disclosed, for example, in U.S. Pat. No. 5,935,883. The entire disclosure of the '883 patent is incorporated herein by reference for all purposes.

Figure 1:
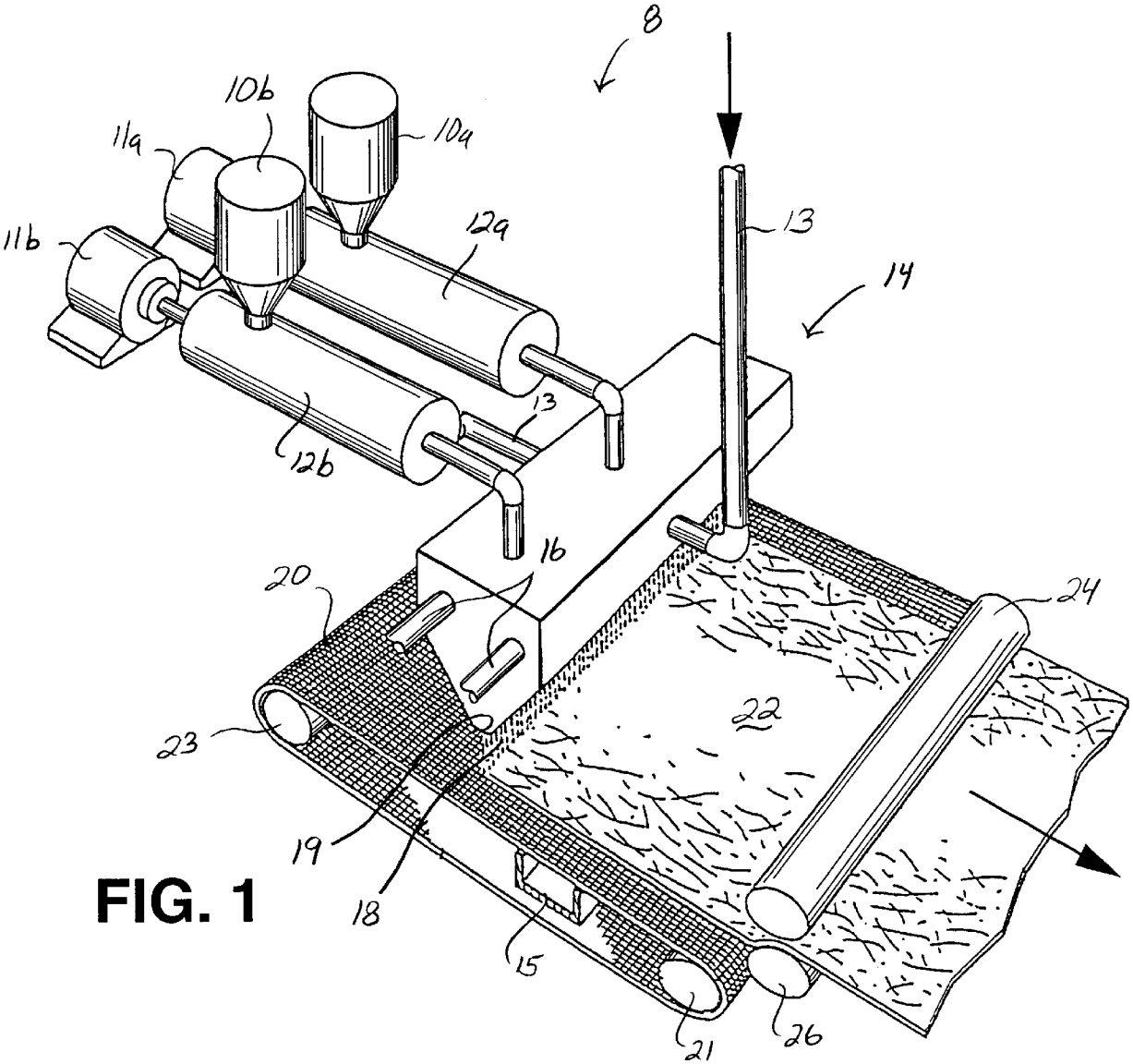
FIG. 1 is a simplified perspective view of a meltblown apparatus for producing bicomponent fibers.

Turning to FIG. 1, a simplified view is offered of a meltblown apparatus 8 for producing bicomponent polymer fibers 18. Hoppers 10*a* and 10*b* provide separate polymers to respective extruders 12*a* and 12*b*. The extruders, driven by motors 11*a* and 11*b*, are heated to bring the polymers to a desired temperature and viscosity. The molten polymers are separately conveyed to a die, generally 14, which is also heated by means of heater 16 and connected by conduits 13 to a source of attenuating fluid. At the exit 19 of die 14, bicomponent fibers 18 are formed and collected with the aid of a suction box 15 on a forming belt 20. The fibers are drawn and may be broken by the attenuating gas and deposited onto the moving belt 20 to form web 22. The web may be compacted or otherwise bonded by rolls 24, 26. Belt 20 may be driven or rotated by rolls 21, 23.

The present invention is also not limited to any particular type of attenuating gas system. The invention may be used with a hot air attenuating gas system, or a cool air system, for example as described in U.S. Pat. Nos. 4,526,733; 6,001,303; and the International Publication No. WO 99/32692. The '733 U.S. patent and international publication are incorporated herein in their entirety for all purposes.

Figure 2:
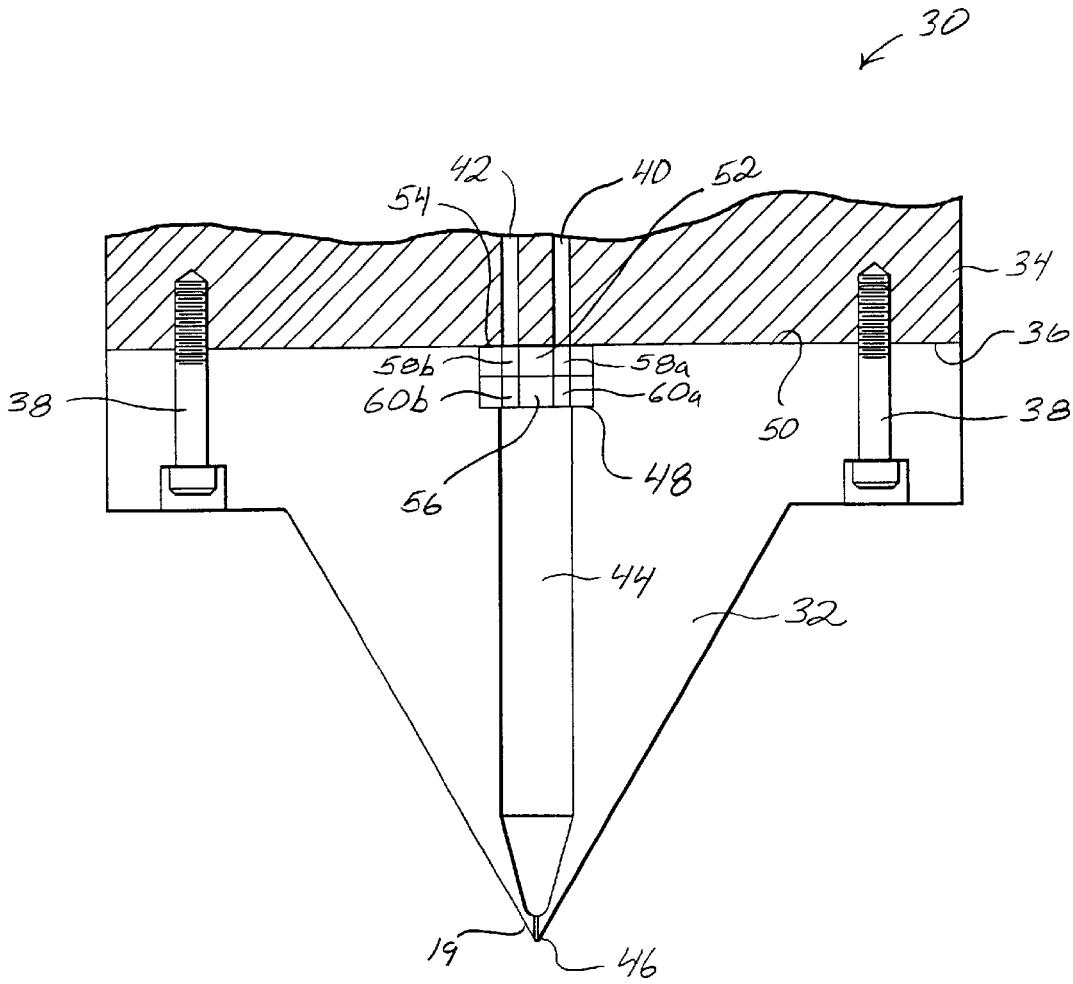
FIG. 2 is a cross-sectional view of components of a die head assembly according to the present invention.

An embodiment of a die head assembly 30 according to the present invention is illustrated in FIG. 2. Assembly 30 includes a die tip 32 that is detachably mounted to an underside 36 of a support member 34. Support member 34 may comprise a bottom portion of the die body, or a separate plate or member that is mounted to the die body. In the embodiment illustrated, die tip 32 is mounted to support member 34 by way of bolts 38.

Separate first and second polymer supply channels or passages 40, 42 are defined through support member 34. These supply passages may be considered as polymer feed tubes. Although not seen in the view of FIG. 2, the supply passages 40, 42 may terminate in elongated grooves defined along underside 36 of support member 34. Any configuration of passages or channels may be utilized to separately convey the molten polymers through support member 34 to die tip 32.

Die tip 32 has a row of channels 44 defined therethrough. Channels 44 may taper downwardly and terminate at exit nozzles or orifices 46 defined along the bottom knife edge 19 of die tip 32. Channels 44 receive and combine the first and second polymers conveyed from support member 34. In forming bicomponent fibers, the polymers do not mix within channel 44, but maintain their separate integrity and an interface or segment line defined between the two polymers. Thus, the resulting fiber structure retains the polymers in distinct segments across the cross-section of the fiber. These segments run longitudinally through the fiber.

The invention is not limited to producing fibers of any particular size. The invention is useful for producing meltblown fibers in the range of about 1–5 microns in diameter, and particularly fibers having an average diameter size of about 3–4 microns.

An elongated recess 48 is defined along a top surface 50 of die tip 32. Recess 48 may run along the entire length of die tip 32. The recess 48 thus defines an upper chamber for each of the die tip channels 44.

An elongated upstream breaker plate 52 and an elongated downstream breaker plate 56 are supported within recess 48.

Figure 3:
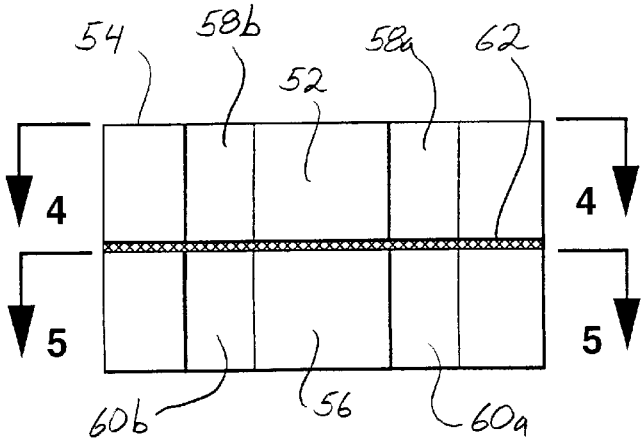
FIG. 3 is a cross-sectional view of an embodiment of the breaker plates according to the present invention.
Figure 4:
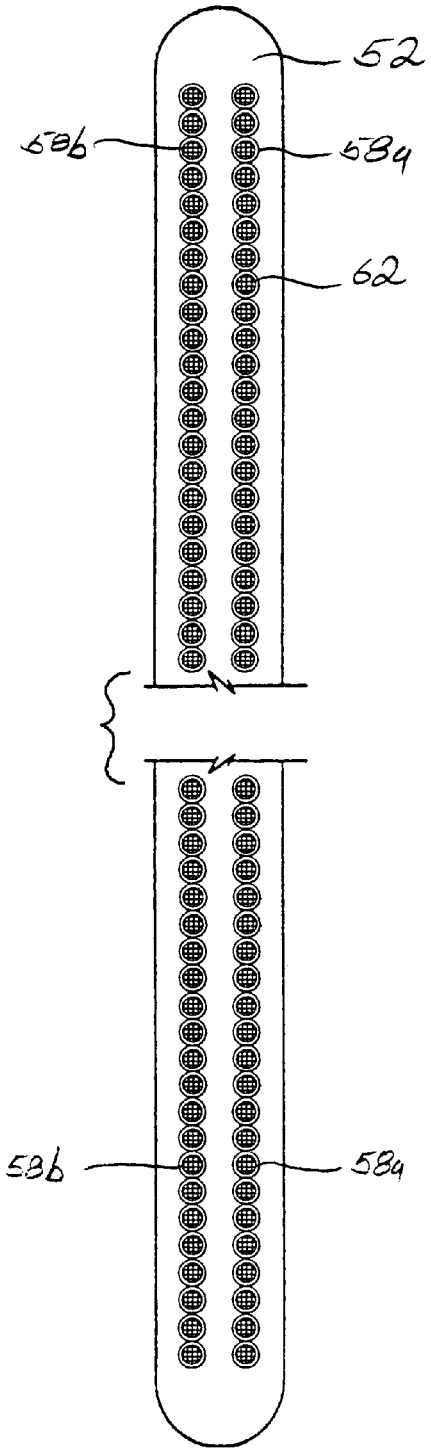
FIG. 4 is a top view of the upstream breaker plate taken along the lines indicated in FIG. 3.
Figure 5:
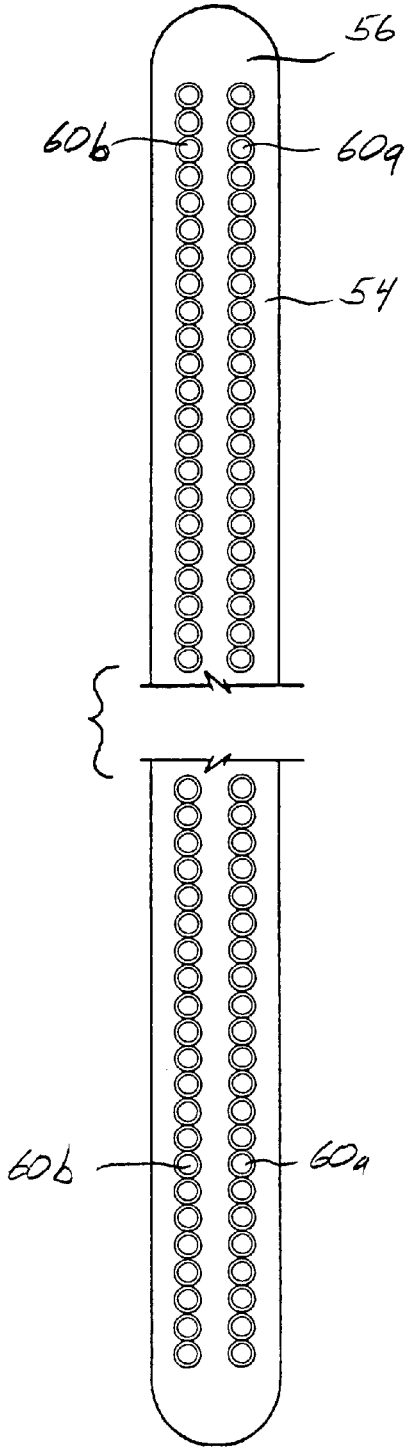
FIG. 5 is a top view of the downstream breaker plate taken along the lines indicated in FIG. 3.

Breaker plates 52, 56 have the same overall shape and dimensions and are supported within recess 48 in a stacked configuration, as particularly seen in FIG. 3. The individual breaker plates are more clearly seen in FIGS. 4 and 5. Each of the breaker plates includes pairs of adjacent holes defined therethrough. Referring to FIGS. 3 through 5 in particular, upstream breaker plate 52 includes adjacent holes 58a and 58*b* forming pairs of holes. These pairs of holes are provided lengthwise along breaker plate 52. Similarly, downstream breaker plate 56 includes adjacent holes 60*a* and 60*b* forming pairs of holes. These pairs of holes are defined lengthwise along breaker plate 56. When assembled in a stacked configuration within recess 48, the holes of the breaker plates 52, 56 align such that a pair of the aligned holes is provided in each upper chamber of each die tip channel 44, as seen in FIG. 2.

A filter device, such as a mesh screen, is disposed within recess 48, for example between upstream breaker plate 52 and downstream breaker plate 56.

The breaker plates 52, 56 may simply rest in recess 48 and are readily removable therefrom upon loosening or removing die tip 32 from support member 34. The breaker plates 52, 56, may be separately removed from die tip 32 and no degree of disassembly between the plates is necessary to remove the plates.

At each channel 44 along die tip 32, the first and second polymers are conveyed through passages or feed tubes 42, 40 defined in support member 34. The polymers flow into respective separate holes 58*a*, 58*b* defined through upstream breaker plate 52. The polymers then flow through filter device 62 (if disposed between the breaker plates) and are separately filtered before flowing into separate respective holes 60*a*, 60*b* of downstream breaker plate 56. Filter device or screen 62 has a thickness and mesh configuration so as to prevent cross-over of the polymers as they flow from upstream breaker plate 52 into downstream breaker plate 56. A 150 mesh to 250 mesh screen is useful in this regard. The polymers flow separately through downstream breaker plate 56 and then into the individual channels 44. In channels 44, the polymers combine into a single molten mass which is extruded out of orifices 46 as bicomponent fibers.

Applicants have found that the construction of a die head assembly described herein allows for efficient spinning of bicomponent polymer fibers having significantly different viscosities without turbulence or distribution issues that have been a concern with conventional bicomponent spinning apparatuses.

Various hole configurations may be defined in breaker plates 52, 56. For example, in the embodiment illustrated, holes 58*a* and 58*b* defined in upstream breaker plate 52 have generally the same diameter. Likewise, holes 60*a* and 60*b* in downstream breaker plate 56 also have generally the same diameter. The diameter of holes 58*a*, 58*b* may be the same as the diameter of holes 60*a*, 60*b*. In an alternative embodiment not illustrated in the figures, hole 58*a* may have a different diameter than hole 58*b*. Likewise, hole 60*a* in downstream breaker plate 56 may have a different diameter than hole 60*b*. Aligned holes 58*a* and 60*a* may have the same diameter. Likewise, aligned holes 58*b* and 60*b* may have the same diameter. It should be appreciated that various combinations of hole sizes and configurations may be utilized to achieve desired metering of the separate polymers through the breaker plates, or to achieve certain desired segmented cross-sectional profiles of the bicomponent fibers. The metering rates of the polymers may also be precisely controlled by means well known to those skilled in the art to achieve desired ratios of the separate polymers.

The breaker plates 52, 56 preferably have a thickness so that the stacked combination of the plates is supported flush within recess 48 such that an upper surface 54 of upstream breaker plate 52 lies flush with, or in the same plane as, top surface 50 of die tip 32. In this embodiment, as illustrated in FIG. 2, die tip 32 can be mounted so that top surface 50 of the dip 32 is against the underside 36 of support member 34. Recess 48 has a width so as to encompass supply passages 42, 40, which may terminate in supply grooves defined along the underside 36 of support member 34.

The present invention provides a die head assembly capable of combining polymers having significantly different viscosities. For example, polymers having up to about a 450 MFR. viscosity difference, and even up to about a 600 MFR viscosity difference, may be processed with the present die head assembly.

It should be appreciated by those skilled in the art that various modifications and variations can be made in the present invention without departing from the scope and spirit of the invention. For example, the die head assembly according to the invention may include various hole configurations defined through the breaker plates. Likewise, the die tip may be configured in any configuration compatible with various known meltblown dies. It is intended that the present invention include such modifications and variations.

What is claimed is:

1. A die head assembly for producing meltblown bicomponent fibers in a meltblown apparatus, said assembly comprising:

a die tip detachably mountable to an underside of an elongated support member, the support member having a first polymer supply passage and a second polymer supply passage defined therethrough;

said die tip having a row of channels defined therethrough terminating at exit orifices along a lower edge of said die tip, said channels receiving and combining first and second polymers conveyed from the support member;

an elongated recess defined in a top surface of said die tip, said recess defining an upper chamber of each said die tip channel;

an elongated upstream and an elongated downstream breaker plate removably supported in a stacked configuration in said recess, said breaker plates having aligned pairs of adjacent holes defined therethrough such that a pair of said aligned holes is disposed in each said upper chamber;

a filter device disposed between said upstream and said downstream breaker plates in said upper chamber; and wherein at each said channel, the first and second polymers conveyed from the support member supply passages flow through respective separate said holes in said upstream breaker plate, flow through said filter device, flow through said aligned holes in said downstream breaker plate, and then flow into and combine in said channels prior to being extruded as bicomponent polymer fibers from said orifices.

2. The die head assembly as in claim 1, wherein said upstream breaker plate rests on said filter device.

3. The die head assembly as in claim 1, wherein said upstream and downstream breaker plates are separately removable from said die tip.

4. The die head assembly as in claim 1, wherein said holes in said upstream breaker plate have essentially the same diameter as said aligned holes in said downstream breaker plate.

5. The die head assembly as in claim 1, wherein said holes in said upstream breaker plate have a different diameter than said aligned holes in said downstream breaker plate.

6. The die head assembly as in claim 1, wherein the individual said holes of said pair of holes within each said chamber have different diameters.

7. The die head assembly as in claim 6, wherein said aligned holes of said breaker plates have essentially the same diameter.

8. The die head assembly as in claim 1, wherein an upper surface of said upstream breaker plate is disposed against said top surface of said die tip.

9. The die head assembly as in claim 8, wherein said die tip top surface is mountable directly against said underside of said support member, the supply passages in the support member defined as elongated grooves, said holes in said upstream breaker plate spaced apart and sized so that said holes align with separate ones of the grooves to prevent crossover or mixing of the polymers between said holes.

10. The die head assembly as in claim 1, wherein said filter device comprises a screen with a mesh configuration and thickness so as to prevent crossover or mixing of the polymers between said breaker plates.

11. A die head assembly for producing meltblown bicomponent fibers in a meltblown apparatus, said assembly comprising:

a die tip detachably mountable to an underside of an elongated support member, the support member having a first polymer supply groove and a second polymer supply groove defined along a bottom surface thereof, said die tip having an upper surface mountable against the bottom surface of the supply member;

said die tip having a row of channels defined therethrough terminating at exit orifices along an edge of said die tip, said channels receiving and combining first and second polymers conveyed from the support member;

an elongated recess defined in a top surface of said die tip, said recess having a width so as to encompass the supply grooves of the support member, said recess defining an upper chamber of each said die tip channel;

an elongated upstream breaker plate and downstream breaker plate removably supported in a stacked configuration in said recess, said breaker plates having pairs of adjacent holes having essentially the same diameter defined therethrough, said pairs of holes vertically aligned such that a pair of said aligned holes is disposed in each said chamber, said chamber holes spaced apart and sized so that said chamber holes align with separate ones of the support member supply grooves to prevent crossover or mixing of the polymers between said chamber holes, said holes in said downstream breaker plate having essentially the same diameter as said holes in said upstream breaker plate;

a filter screen disposed between said breaker plates; and wherein at each said channel, the first and second polymers conveyed from the support member supply grooves flow through respective separate said holes in said upstream breaker plate, flow through said filter screen, flow through said aligned holes in said downstream breaker plate, and then flow into and combine in said channels prior to being extruded as bicomponent polymer fibers from said orifices.

* * * * *